US005295900A

United States Patent [19]

Tsuchida et al.

[11] Patent Number: 5,295,900

[45] Date of Patent: Mar. 22, 1994

[54] COIN DISPENSING DEVICE

[75] Inventors: Tamotsu Tsuchida; Yorio Suzukawa, both of Saitama, Japan

[73] Assignee: Asahi Seiko Kabushiki Kaisha, Tokyo, Japan

[21] Appl. No.: 984,909

[22] Filed: Dec. 2, 1992

[30] Foreign Application Priority Data

Dec. 2, 1991 [JP] Japan ..... 3-357420

[51] Int. Cl.[5] ..... G07D 1/00

[52] U.S. Cl. ..... 453/57; 221/203

[58] Field of Search ..... 453/12, 32, 49, 57; 221/182, 203

[56] References Cited

U.S. PATENT DOCUMENTS

| | | | |
|---|---|---|---|
| 3,396,737 | 8/1968 | Picollo | 221/182 X |
| 3,422,824 | 1/1969 | Persson | 453/57 X |
| 3,788,334 | 1/1974 | Saraceno et al. | 221/182 X |
| 3,818,918 | 6/1974 | Nissmo et al. | 453/57 |
| 3,948,280 | 4/1976 | Dahl et al. | 453/57 |
| 4,036,242 | 7/1977 | Breitenstein et al. | 453/57 X |
| 5,000,718 | 3/1991 | Abe | 453/57 |
| 5,092,817 | 3/1992 | Abe | 221/203 X |

FOREIGN PATENT DOCUMENTS

| | | | |
|---|---|---|---|
| 0311320 | 4/1989 | European Pat. Off. | 453/49 |

*Primary Examiner*—Michael S. Huppert
*Assistant Examiner*—Scott L. Lowe
*Attorney, Agent, or Firm*—Hopgood, Calimafde, Kalil, Blaustein & Judlowe

[57] ABSTRACT

A coin dispensing device comprises a hopper 1 where a supply of coins is held in bulk. The coins are transported one by one on a coin dispensing disc 3 rotatably supported by a rotary shaft 2 for use in dispensing a coin. A base plate 20 is opposed to the coin dispensing disc 3 at a predetermined distance. The coin dispensing device also comprises guide holes 14 penetrating through the coin dispensing disc 3. Each of the guide holes 14 receives one of agitating members 13 which travels along a predetermined orbit on the base plate 20 accompanying with rotation of the coin dispensing disc 3. An extrusion member 50 is disposed on the base plate 20 along the orbit. The extrusion member 50 has a predetermined relative height to the base plate 20 to make a portion of the agitating member be protruded, as the agitation protruding end 13*a*, through the guide hole 14 from the coin dispensing disc 3 when the agitating member 13 passes on the extrusion member 50 along the orbit.

11 Claims, 9 Drawing Sheets

PRIOR ART

PRIOR ART

COIN DISPENSING DEVICE

BACKGROUND OF THE INVENTION

This invention relates to a coin dispensing device having a hopper where a supply of coins or tokens are held in bulk and the coins are transported therefrom one by one.

Such a coin dispensing device is well known in the art as disclosed in, for example, Japanese Unexamined Patent Prepublication No. 173891/1990, which issued in the United States as U.S. Pat. No. 5,000,718;

As shown in FIG. 7, a conventional coin dispensing device comprises a coin dispensing disc 3 for dispensing the coins one by one. The coin dispensing disc 3 is rotatably supported in a hopper 1 by a rotary shaft 2 inclined to the horizontal. The coin dispensing device also comprises a fixed supporting plate 20 and a carrier 12. The fixed supporting plate 20 is disposed opposite to the coin dispensing disc 3 and is inclined thereto, plate 20 and disc 3 being positioned apart from each other at a predetermined distance. The carrier plate 12 is inclined to the coin dispensing disc 3 and is interposed between the coin dispensing disc 3 and the fixed supporting plate 20. The carrier 12 rotates in cooperation with the coin dispensing disc 3. The coin dispensing disc 3 comprises a plurality of guide holes 14, 14, . . . passing therethrough. Each of the guide holes 14, 14, . . . receives one of a plurality of agitating members 13. The agitating members 13 are equal in number to the guide holes 14. Each of the agitating members 13 is protruded from and withdrawn into the respective guide hole 14. When the coin dispensing disc 3 and the carrier plate 12 rotate, the agitating members 13 are rotated in an orbital path.

The inclined angle of the carrier 12 to the coin dispensing disc 3 is adjusted such that the amount of protrusion of the agitating member 13 is substantially equal to zero or minimum at a coin throwing or discharge outlet at the upper side of the coin dispensing disc 3. In addition, at the lower or bottom position of the coin dispensing disc 3 where a supply of coins is held in bulk, the agitating member 13 protrudes into the hopper 1 in a maximum amount.

A mechanism for adjusting the inclined angle of the carrier 12 and for making the agitating members 13 protrude or withdraw within guide holes 14 mainly consists of the fixed supporting plate 20, a plurality of carrier supporting plate bearing balls 31, 31, . . . a circular race 32 and a spring 36. The carrier supporting plate bearing balls 31, 31 . . . are held on a supporting surface 22 of the fixed supporting plate 20 by means of a retainer ring 30. The carrier supporting plate balls 31, 31 . . . are equally apart from each other along the circumference of the coin dispensing disc 3. The circular race 32 is used for positioning the carrier supporting plate bearing balls 31, 31, . . . on the supporting surface 22. A spring 36 is interposed between the coin dispensing disc 3 and the carrier plate 12 to force the center of the carrier plate 12 against the supporting surface 22.

The coin dispensing disc 3 has a central platform portion 4 and coin dispensing pieces elements 5. The central platform portion 4 is arranged in the inner periphery of the coin dispensing disc 3. The central platform portion 4 has a peripheral flange 4*a* the height of which height is substantially equal to the thickness of one coin. Each of the coin dispensing pieces or elements 5 is disposed on a peripheral portion 3*a* of the coin dispensing disc 3 so as to protrude into the hopper 1. The central platform portion 4 is fixed to the coin dispensing disc 3 by means of a screw pin 42. The coin in the hopper 1 is held between the peripheral flange 4*a* of the central platform portion 4 and one of the coin dispensing piece or element 5. The coin is then transported to the upper portion of the device. The coin dispensing disc 3 is rotatably supported by means of the rotary shaft 2 through a drive pin 40 and an engaging pin 41. The drive pin 40 is protruded from the rotary shaft 2 along the radius of the coin dispensing disc 3. The engaging pin 41 is used for engaging the coin dispensing disc 3 to the drive pin 40.

The screw pin 42 passes through the coin dispensing disc 3 and the central platform portion 4 thereof. The screw pin 42 engages with an engaging slot 43 of the carrier plate 12 through a bearing 44 to drivingly connect the coin dispensing disc 3 and carrier plate 12 such that they rotate together.

A spring 35 is fastened at the end of rotary shaft 2 which passes through the coin dispensing disc 3 and the central platform portion 4. The spring 35 is fastened through a washer 37 by means of a screw 38 to force the coin dispensing disc 3 and the central platform against fixed supporting plate 20.

The peripheral portion 3*a* of the coin dispensing disc 3 is rotatably connected to a disc supporting surface 21 of the fixed supporting plate 20 through a plurality of disc supporting balls 26. The disc supporting balls 26 are arranged along the circumference of the coin dispensing disc 3, equally apart from each other, on the disc supporting surface 21 with a retainer ring 25. Each of the disc supporting balls 26 is positioned by means of a circular race 27.

With the above mentioned structure, the protrusion amount of the agitating member 13 varies as the coin dispensing disc 3 is rotated. As a result, at the bottom portion of the coin dispensing disc 3, coins held in the hopper 1 are agitated by the protruding agitating member or members 13. The protruding agitating member 13 is withdrawn from the surface of the coin dispensing disc 3 at the upper portion thereof to avoid unnecessary forcing of the coin.

Turning to FIG. 8, the conventional coin dispensing device comprises, as mentioned above, the coin dispensing pieces or elements 5 which protrude from the coin dispensing disc 3 in the hopper 1 to pick up the coin. Each of the coin dispensing pieces or elements 5 protrudes from and withdraws from the coin dispensing disc 3 in the same manner as the agitating members 13. In other words, the coin dispensing pieces protrude and are withdrawn in cooperation with the above mentioned mechanism for adjusting the inclined angle of carrier plate 12 and for enabling the agitating members 13 to protrude or withdraw. The amount of protrusion of the coin dispensing pieces 5 at the upper portion of the coin dispensing disc 3 is adjusted such that the coin is transported one by one.

However, the above mentioned conventional coin dispensing device requires relatively complex mechanism for adjusting the inclined angle of the carrier. As a result, more parts and components are used for this mechanism, which render the assembly operation thereof somewhat difficult and time consuming.

Accordingly, with respect to the above mentioned problems, an object of the present invention is to provide a coin dispensing device using a more simple mechanism for adjusting the inclined angle of the carrier and for enabling the agitating members to protrude or withdraw easily which is indispensable in the conventional device.

Another object of the present invention is to provide a coin dispensing device which enables effective agitation of the coin while avoiding the pushing of the coin by the agitating members.

SUMMARY OF THE INVENTION

According to the present invention, the following is provided a coin dispensing device comprising a rotary plate rotatably supported by a rotary shaft for use in dispensing a coin and a base plate disposed opposite to the rotary plate at a predetermined distance, the coin dispensing device comprises guide holes penetrating through the rotary plate; agitating members each of which faces to the respective guide hole and which travels along a predetermined orbit on the base plate by means of rotation of the rotary plate; and an extrusion member disposed on the base plate along the orbit. The extrusion member has a predetermined relative height to the base plate to enable a portion of the agitating member to protrude therethrough, as the agitating protruding portion, through the guide hole from the rotary plate when the agitating member in question passes through the extrusion member along the orbit.

In addition, according to the present invention, described hereinabove, the extrusion member comprises, at least a part thereof, an elastic material which is elastically deformed by a predetermined stress applied to the agitating member protruded on the rotary plate.

Further, according to the present invention, in the coin dispensing device, the extrusion member is a cantilevered spring plate having a free end extending in the rotating direction of the rotary plate.

The present invention further provides the coin dispensing device where the agitating member comprises, at least a part thereof, a spherical surface portion. Further, the agitating member may comprise, at least a part thereof, an elastomer material.

In addition, the present invention provides the coin dispensing device where the remaining portion of the agitating member comprises, at least a part thereof, a spherical surface portion. The remaining portion of the agitating member may comprise a lubricant at the spherical surface portion.

Further, according to the present invention, the coin dispensing device is provided in which the agitating member is substantially spherical.

Still further, according to the present invention, in the above mentioned coin dispensing device, the rotary plate comprises a flange portion defining the guide hole at the side of the base plate. The flange portion has a protrusion taper surface corresponding to the spherical agitating member.

In addition, according to the present invention, the coin dispensing device can be provided where the rotary plate comprises a flange portion defining the guide hole at the side of the base plate and the remaining portion of the agitating member has an engaging piece which engages with the flange portion.

Additionally, according to the present invention, the coin dispensing device further comprises a forcing member disposed between the flange portion and the engaging piece for forcing the agitating member to the base plate.

BRIEF DESCRIPTION OF THE DRAWINGS

The above mentioned features and other features as well as the advantages and effects of the present invention will be more apparent from the following detailed description of the embodiment with reference to the drawings in which.

DETAILED DESCRIPTION OF THE PREFERRED EMBODIMENTS

The present invention will be described below with reference to the drawings.

Figure 1:
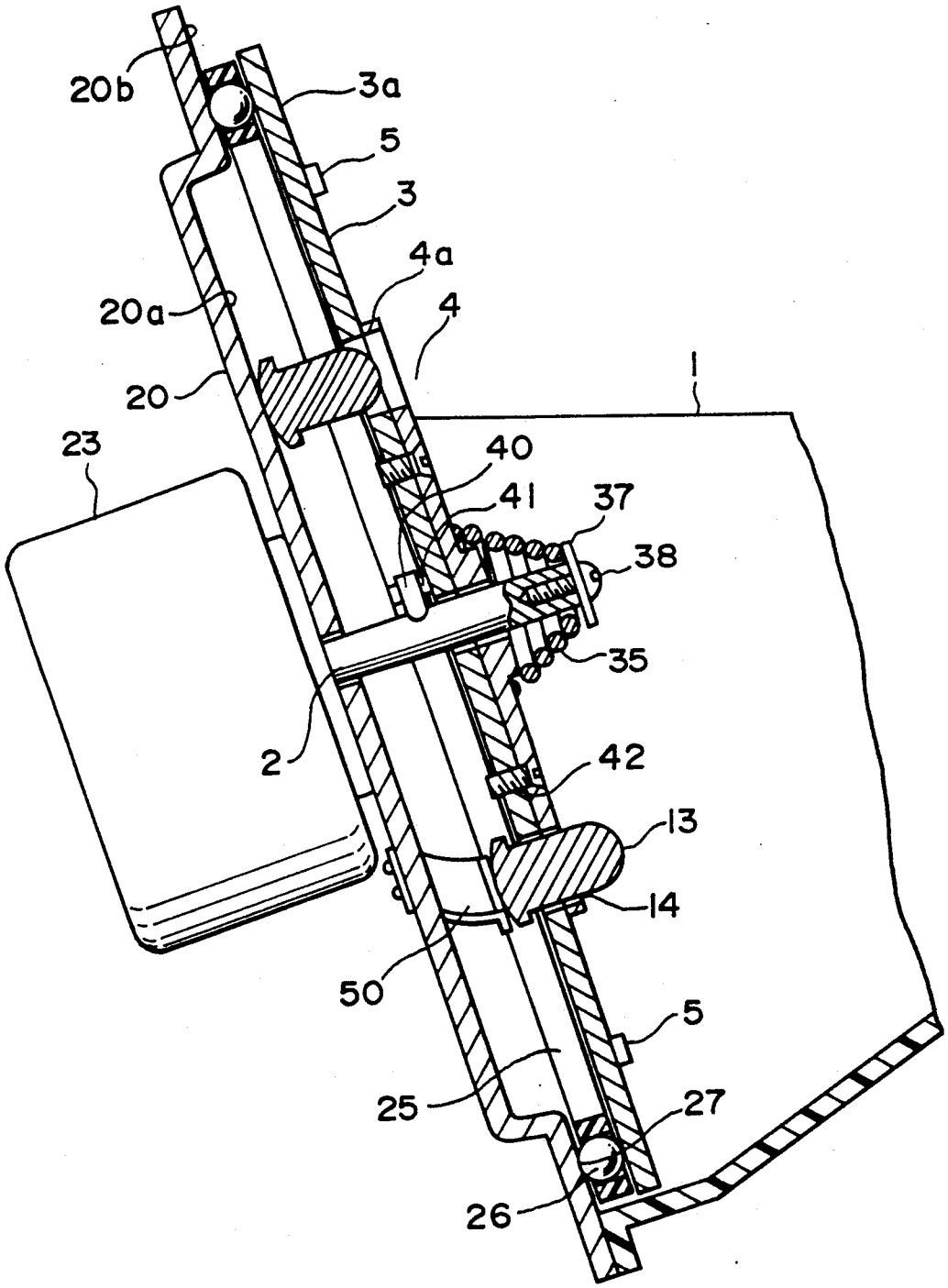
FIG. 1 is a sectional view of the coin dispensing device taken on the line 1—1 in FIG. 2 according to a first embodiment of the present invention.
Figure 2:
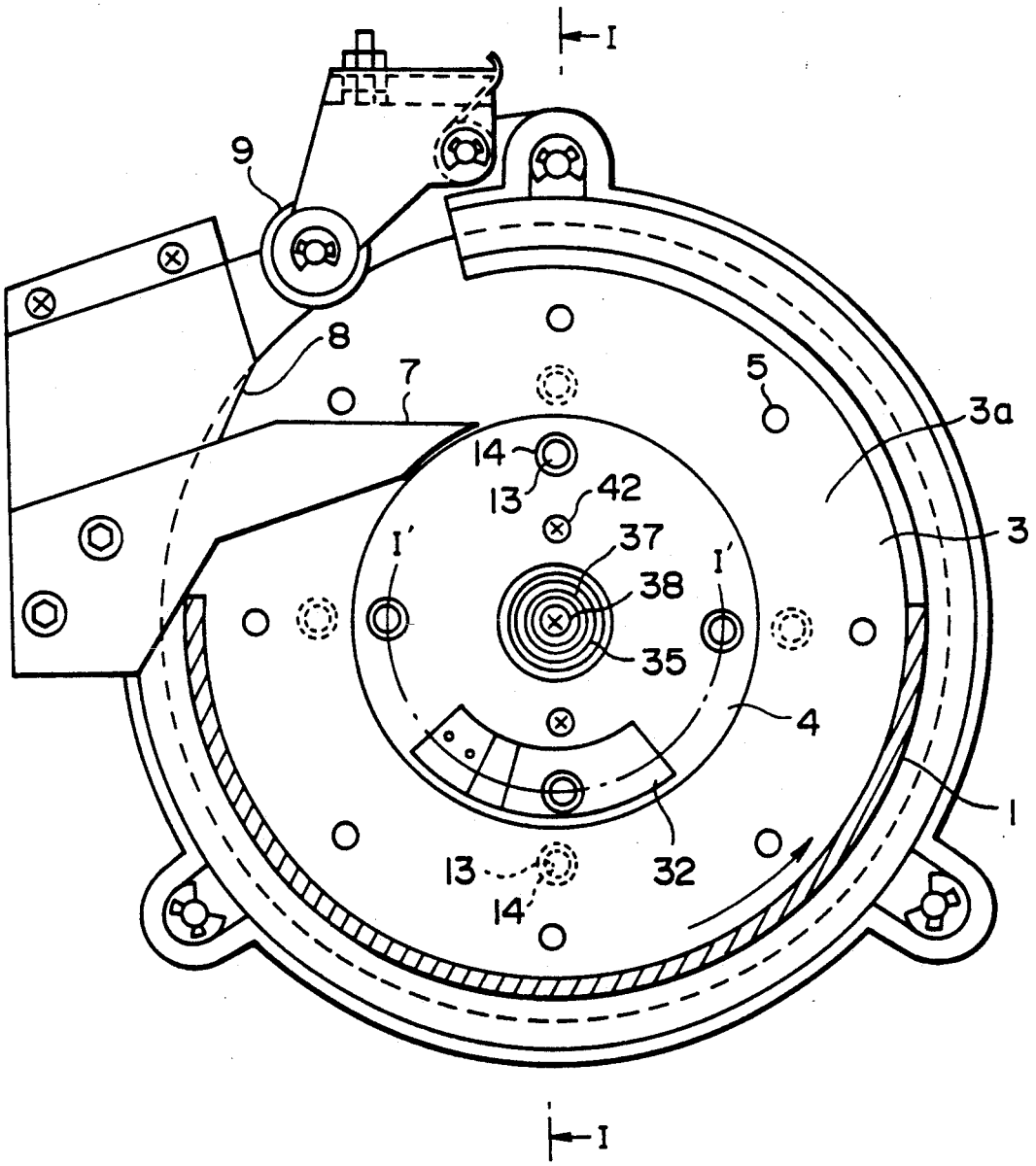
FIG. 2 is a front view of the coin dispensing device according to the first embodiment of the present invention.

As shown in FIGS. 1 and 2, the coin dispensing device comprises a hopper 1 where a supply of coins is held in bulk. The hopper 1 is fastened to a base plate or a fixed supporting plate 20. The fixed supporting plate 20 is inclined to the horizontal at the angle of 45° . It is apparent that the hopper 1 may also be used in an approximately transversal or horizontal position.

The fixed supporting plate 20 consists of a flat bottom portion 20*a* and a disc supporting surface 20*b*. The disc supporting surface 20*b* is extended from the periphery of the bottom portion 20*a* in the direction towards the hopper 1 to be bent to form a flange.

A coin dispensing disc 3 is used for dispensing the coin in the hopper 1 and has one side opposing to the fixed supporting plate 20 in parallel. The other side of the coin dispensing disc 3 faces to the hopper 1. The coin dispensing disc 3 comprises a central platform portion 4 and coin dispensing pieces 5. The central platform portion 4 is arranged in the inner periphery of the coin dispensing disc 3. The central platform portion 4 has a peripheral flange 4*a* of which the height thereof is substantially equal to the thickness of one coin. Each of the coin dispensing pieces 5 is disposed on a peripheral portion 3*a* of the coin dispensing disc 3 so as to protrude into the hopper 1. The central platform portion 4 is fixed to the coin dispensing disc 3 by means of a screw pin 42. Each of the coin in the hopper 1 is received between the peripheral flange 4*a* of the central platform portion 4 and one of the coin dispensing piece 5. The coin is then transported to the upper portion of the device.

A rotary shaft 2 passes through the coin dispensing disc 3 and the central platform portion 4 and is driven by a motor 23. The coin dispensing disc 3 and the central platform portion 4 are rotatably supported by means of the rotary shaft 2 through a drive pin 40 and an engaging pin 41. The drive pin 40 protrudes from the rotary shaft 2 along the radius of the coin dispensing disc 3. The engaging pin 41 is used for engaging the coin dispensing disc 3 to the drive pin 40.

A spring 35 is fastened to the end of the rotary shaft 2 passing through the coin dispensing disc 3 and the central platform portion 4. The spring 35 is fastened through a washer 37 by means of a screw 38 to force the coin dispensing disc 3 and the central platform against fixed supporting plate 20.

The peripheral portion 3*a* of the coin dispensing disc 3 is rotatably connected to the disc supporting surface 20*b* of the fixed supporting plate 20 through a plurality of disc supporting balls 26. The disc supporting balls 26 are arranged along the circumference of the coin dispensing disc 3, equally apart from each other, on the disc supporting surface 20*b* with a retainer ring 25. Each of the disc supporting balls 26 is positioned by means of a circular race 27.

Figure 3:
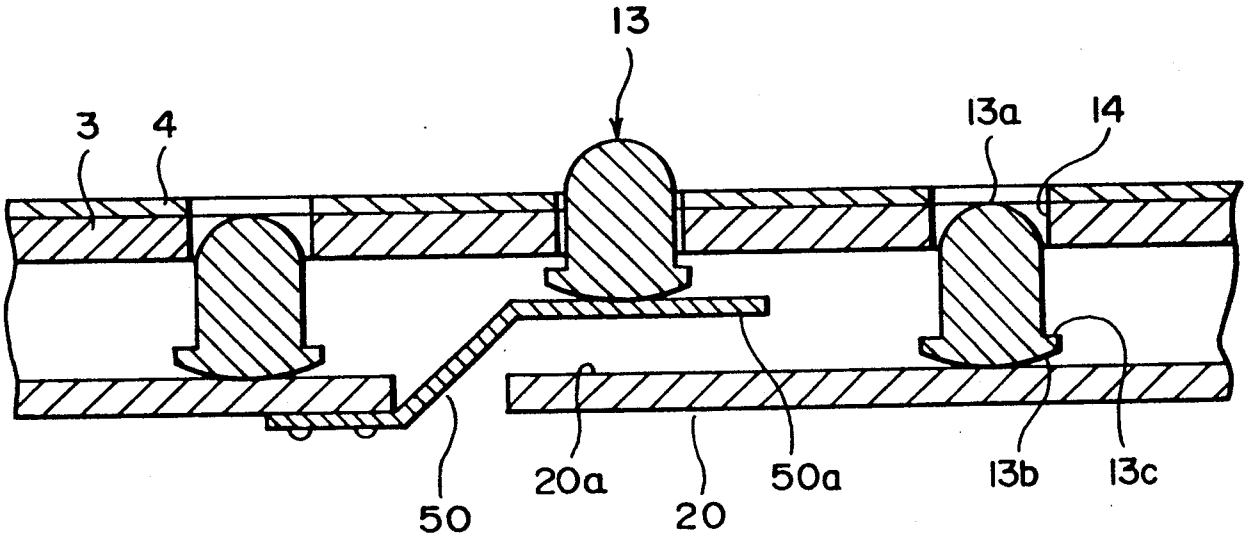
FIG. 3 is a sectional view of agitating members and an extrusion member in the coin dispensing device taken on the line 1—1 in FIG. 2 according to the first embodiment of the present invention.

With reference to FIGS. 2 and 3, the coin dispensing disc 3 and the central platform portion 4 comprise a plurality of guide holes 14, 14, . . . passing therethrough. It is apparent that the guide holes may be formed on the peripheral portion 3*a* as indicated by the dotted line in FIG. 2.

Each of the guide holes 14, 14, . . . receives one of their corresponding agitating member 13. The agitating members 13 are equal in number to the guide holes 14. Each of the agitating members 13 protrudes from and is withdrawn into the guide hole 14. When the coin dispensing disc 3 and the carrier plate 12 rotate, the agitating members 13 are rotated in an orbital path. A circular race (not shown) may be provided on the bottom portion 20*a* for positioning the agitating member 13.

At a part of the bottom surface 20*a*, corresponding to the lower portion of the coin dispensing disc 3 where a supply of coins is held in bulk in the hopper 1, an extrusion member 50 is securely attached. The extrusion member 50 is disposed such that the agitating member 13 can pass thereon and therealong. When one of the agitating members 13 is on the extrusion member 50, a top of the agitating member 13 in question is caused to protrude; as an agitation protruding end 13*a*, from the surface of the central platform portion 4 through the guide hole 14. After passing along extrusion member 50, agitating member 13 falls back to its orbit on the bottom portion 20*a* through the guide hole 14 due to the gravity.

In this embodiment, the extrusion member 50 is formed as a cantilevered spring plate having a free end 50*a*. The free end 50*a* is extended in the rotation direction of the coin dispensing disc 3 (depicted by an arrow in the figure). Because of the elasticity or flexing of the free end 50*a* of the cantilevered spring plate, the agitation protruding end 13*a* of the agitating member 13 is affected by the reduced stress or load generated by the coin passing therethrough.

It is noted that the extrusion member 50 is not limited to the cantilevered spring plate. Thus, any one of like components can be used which has an adequate height from the bottom portion 20*a* and capable of causing the agitating members 13 to protrude from the central platform portion 4.

In addition, it is apparent from the spirit and scope of the present invention that the bottom portion 20*a* may comprise a concave or a slit-like lowered portion (not shown) where the agitating member 13 is received and withdrawn from the surface of the central platform portion 4.

An elastomer material (not shown), such as urethane rubber, may be attached on or embedded into the agitating members 13 to increase the frictional coefficient thereof and to effectively prevent the coins from forming a so-called bridge.

Further, in order to smoothly pass the agitating members 13 on the extrusion member 50, a rear end 13*b* of the agitating member 13 is provided with a spherical shape. A thin film of the synthetic resin (not shown) or the like, such as a carbon-containing nylon sheet, is attached or embedded into the spherical portion of the rear end 13*b* as a lubricant, thereby effectively reducing the friction generated between the bottom portion 20*a* and the extrusion member 50.

An engaging flange 13*c* is provided at the rear end 13*b* of agitating member 13. The engaging flange 13*c* is engaged with the flange portion of the coin dispensing disc 3 at the side close to the fixed supporting plate 20 when the agitation end 13*a* protrudes from the central platform portion 4. In this manner, the engaging flange 13*c* contributes to prevent the agitating member 13 from falling down to hopper 1 through the guide hole 14.

Figure 4:
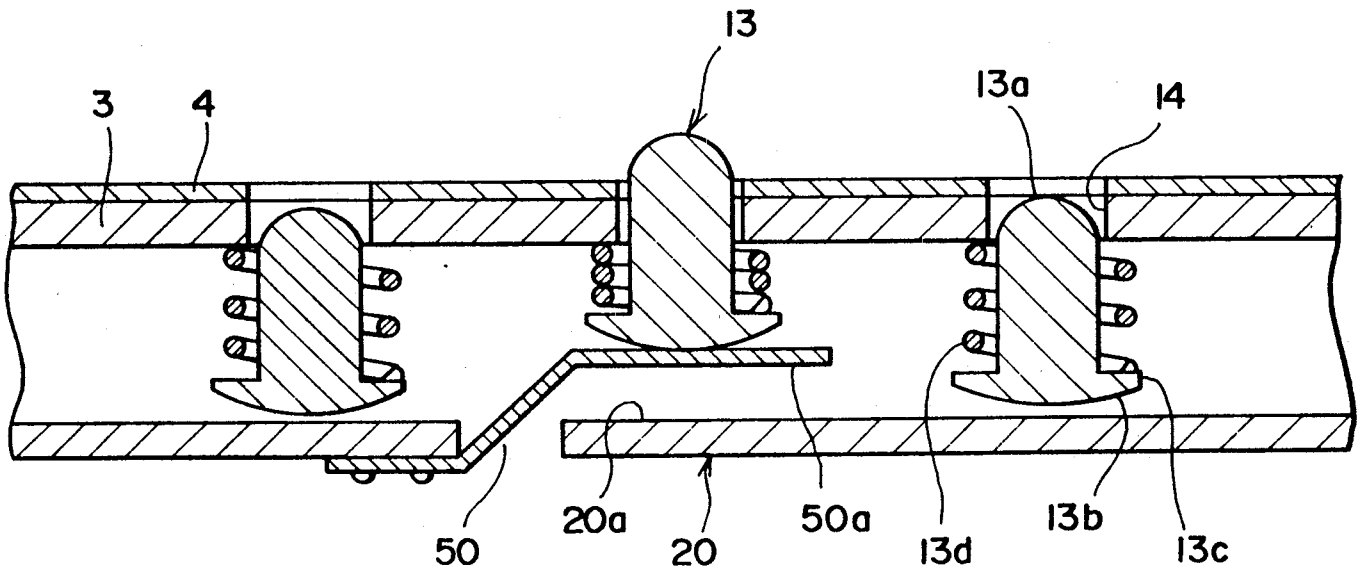
FIG. 4 is a sectional view of the agitating members and the extrusion member according to a second embodiment of the present invention.

Another embodiment of the agitating member 13 is shown in FIG. 4. As shown in FIG. 4, a return spring 13*d* for forcing the agitating member 13 to the fixed supporting plate 20 may be provided between the flange portion of the coin dispensing disc 3 and the engaging flange 13*c*. It is apparent that, as an alternative for the return spring, any forcing members such as a blade spring may be equally capable of generating the spring force. Due to the spring force of the return spring 13*d*, the agitating member 13 on the extrusion member 50 is forcefully caused to fall down on its traveling orbit on the bottom portion 20*a* through guide hole 14.

In this embodiment, one end of the return spring 13*d* is connected to the coin dispensing disc 3 and the other end thereof is connected to the engaging flange 13*c*, thereby suspending the agitating member 13 itself to separate it from the fixed supporting plate 20.

Figure 5:
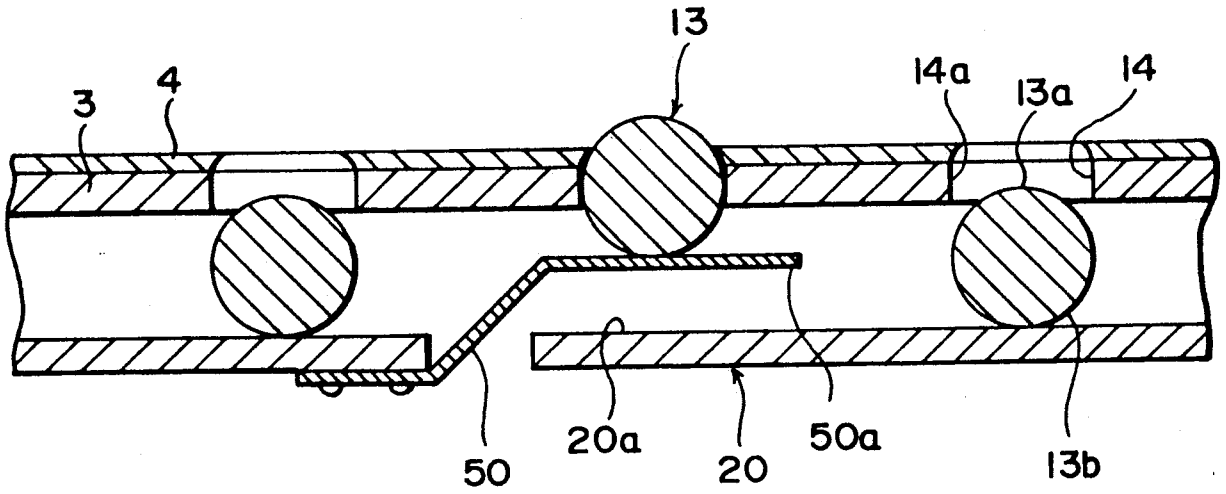
FIG. 5 is a sectional view of the agitating members and the extrusion member according to a third embodiment of the present invention.

As an the alternative embodiment of the agitating members 13, as shown in FIG. 5, each of the agitating members 13 may be formed as a sphere. A protrusion taper surface 14*a* is formed in the guide hole 14 at its end close to the fixed supporting plate. The taper surface 14*a* has a slightly spherical contour to correspond to the spherical surface of agitating member 13. Thus, the amount of protrusion of protruding end 13*a* is increased. In addition, it is possible to prevent the agitating members 13 from fallen down to hopper 1 through the guide hole 14.

Figure 6:
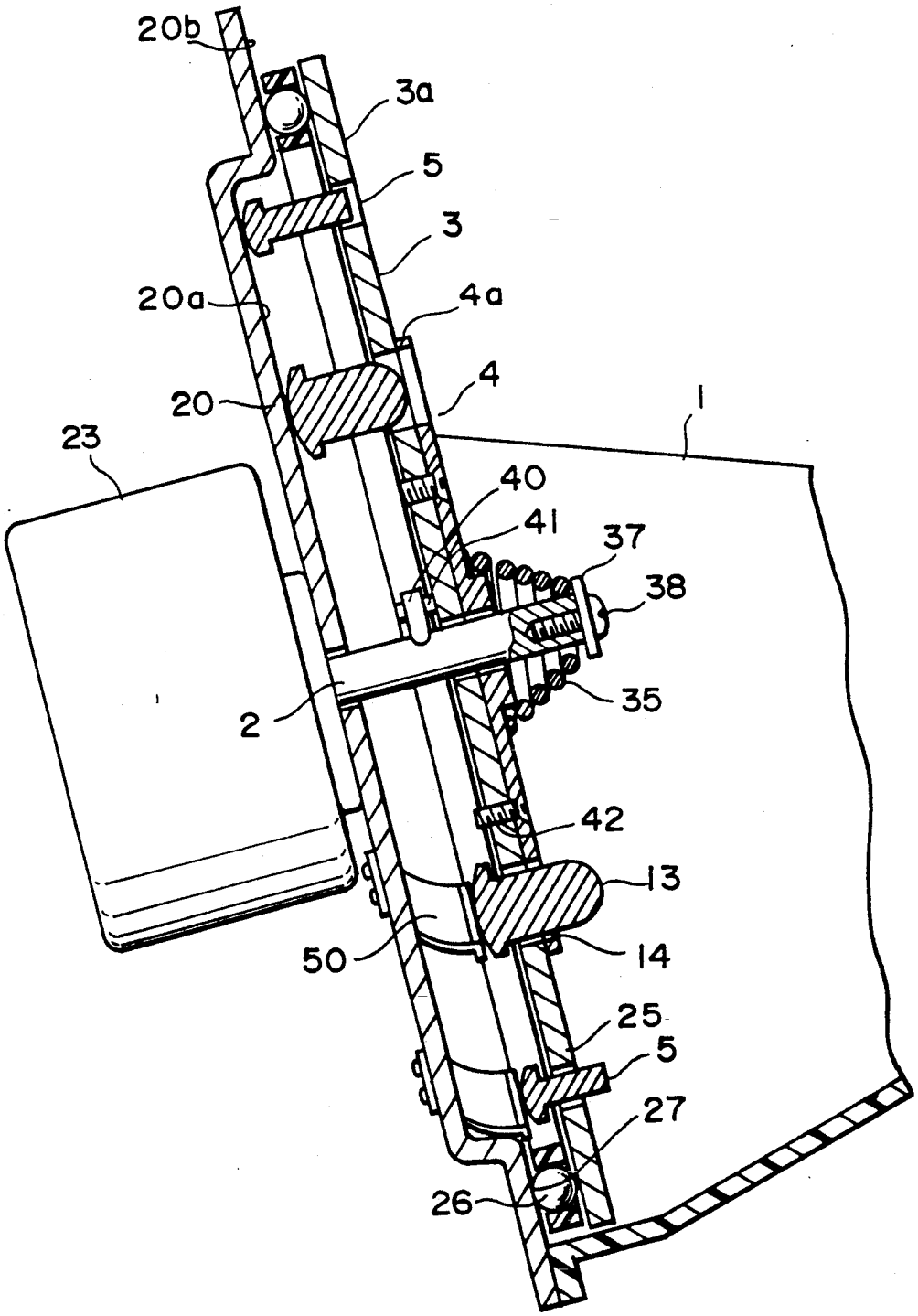
FIG. 6 is a sectional view showing coin dispensing pieces according to a fourth embodiment of the present invention.
Figure 7:
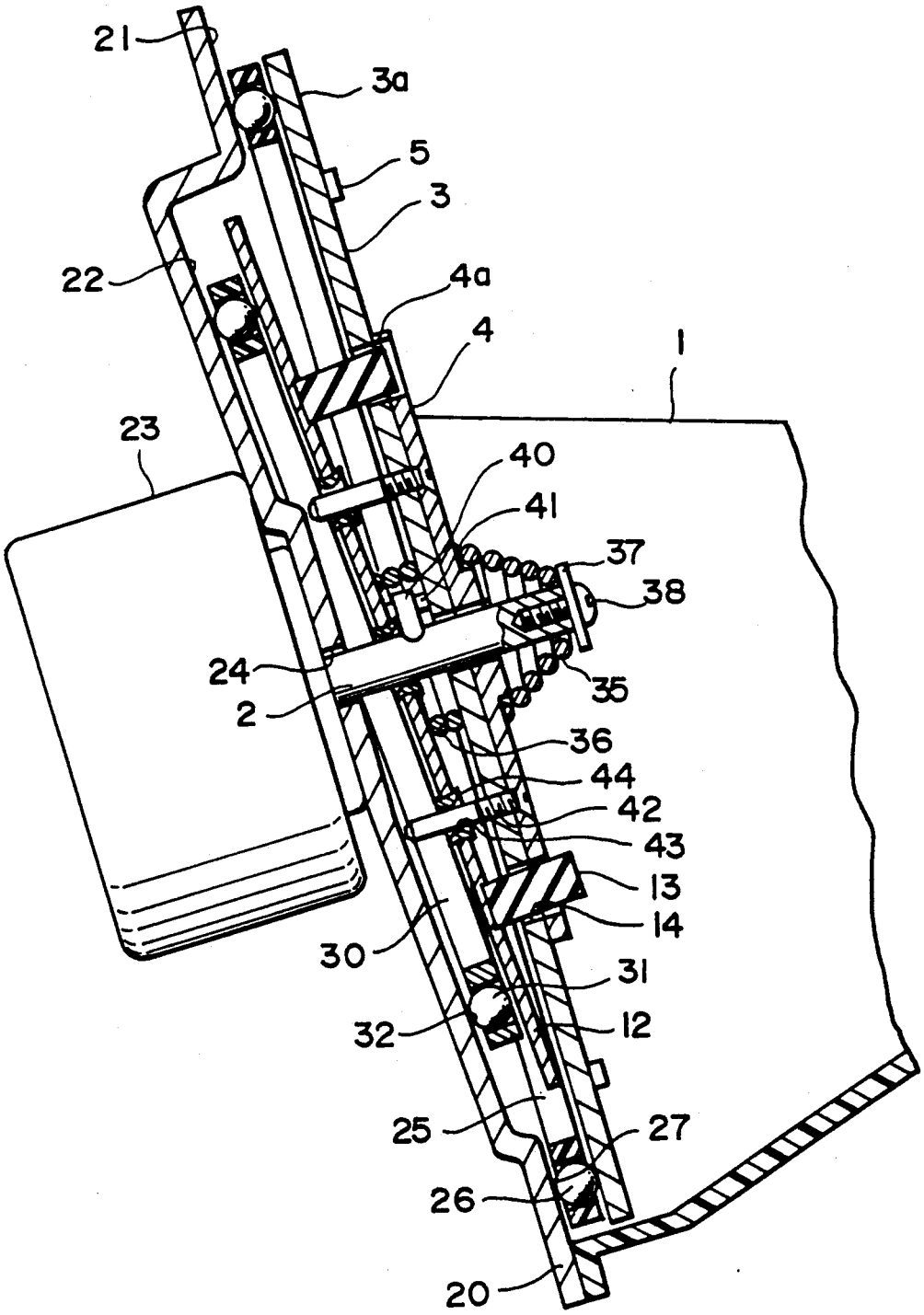
FIG. 7 PRIOR ART
FIG. 7 is a sectional view showing a conventional coin dispensing device.
Figure 8:
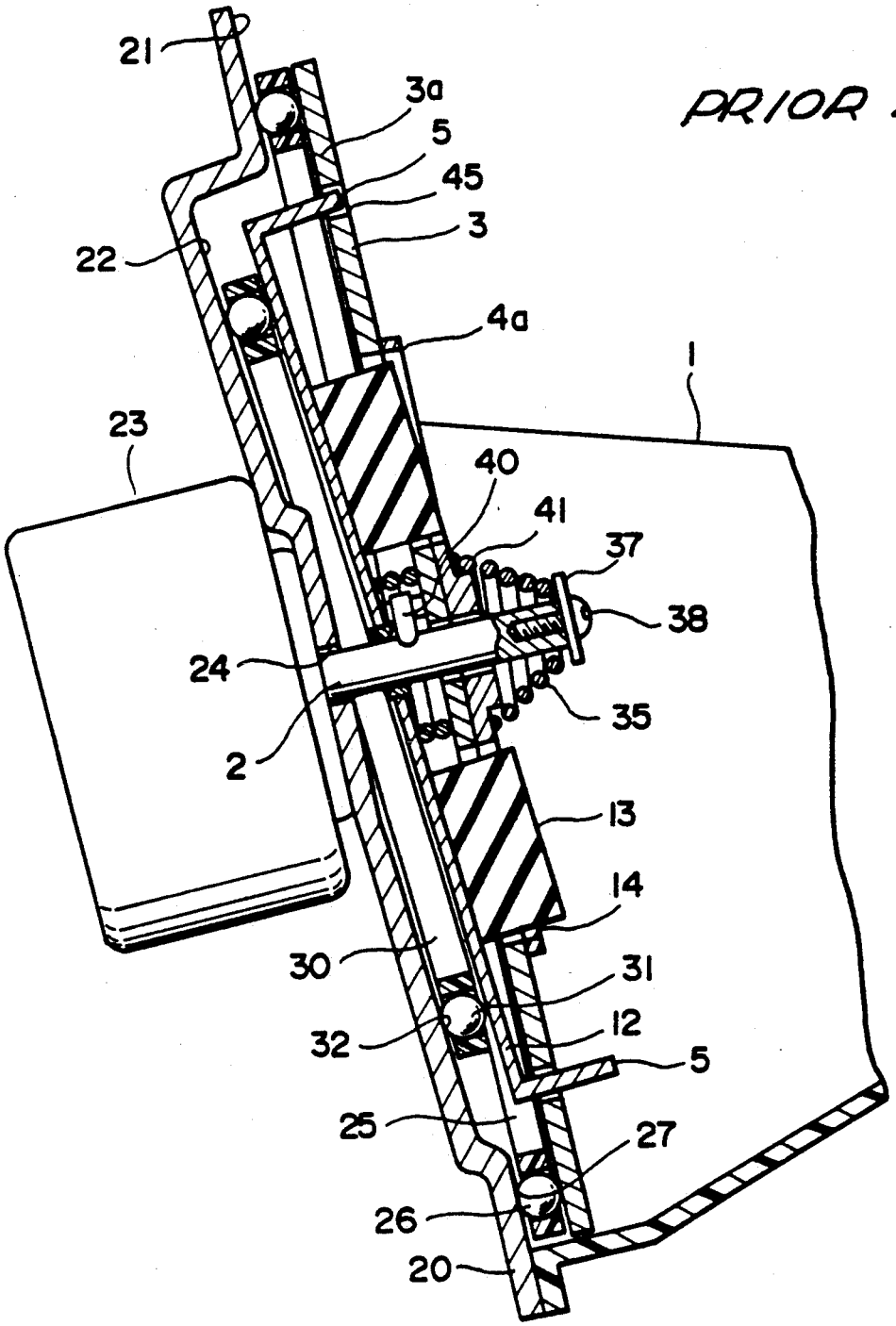
FIG. 8 is a sectional view showing another conventional coin dispensing device.

As shown in FIG. 6, the coin dispensing piece 5 for picking up the coin may be formed in a similar manner as the agitating member 13 such that it can protrude and be withdrawn from the peripheral portion 3*a* of the coin dispensing disc 3 by means of an extrusion member or the like. By means of this, it may also be possible to adjust the amount of protrusion of coin dispensing piece 5 to receive the coin one by one at the upper portion of the coin dispensing disc 3.

Figure 9:
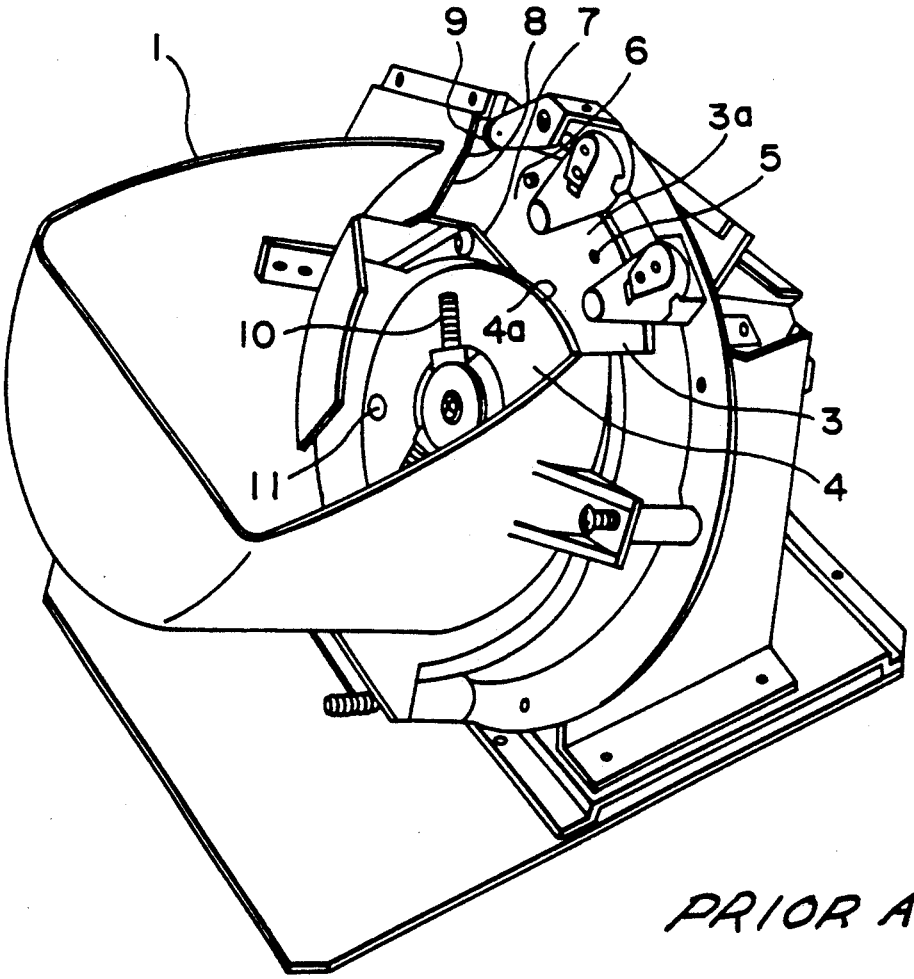
FIG. 9 is a perspective view of a typical coin dispensing device.

As shown in FIGS. 2 and 9, when a supply of coins is agitated by agitating members 13 in the hopper 1 and then picked up by the coin dispensing piece 5 and the peripheral flange 4a of the central platform portion 4, the picked up coin is transported to the upper outlet 6 opened at the upper portion of the coin dispensing disc 3. An output knife 7 is disposed at or around the upper outlet 6. The outlet knife 7 is extended across the peripheral portion 3a of the coin dispensing disc 3 in the tangential direction of the peripheral flange 4a of the central platform portion 4. The outlet knife 7 picks up the coin from the peripheral flange 4a in contact relation therewith to transport it to the outlet 8.

A coin counting roller 9 is disposed at the upper portion of outlet knife 7. The coin counting roller 9 is forced by a spring (not shown) to outlet knife 7. The coin transported to outlet 8 by outlet knife 7 pushes roller 9 against the spring force of the spring, thereby the number of coins can be counted with the coin counting roller 9. When the coin counting roller 9 counts a predetermined number of coins, motor 23 is stopped. Therefore, the coin dispensing disc 3 is also stopped.

As mentioned above, according to the present invention, it is possible to provide the coin dispensing device which requires no mechanism for adjusting the inclined angle of the carrier and for enabling the agitating members to protrude or withdraw. Such a structure can be achieved by a combination of the agitating member and the extrusion member. Thus, it becomes possible to provide a coin dispensing device having a simple structure which can be readily assembled. In addition, the coin dispensing device according to the present invention enables effective agitation of the coin while avoiding the pushing of the coin by the agitating member.

While the present invention has thus been described in conjunction with the preferred embodiment thereof, it is readily understood by those skilled in the art that various modifications and additions can be possible without departing from the scope and spirit described in the attached claims.

What is claimed is:

1. A coin dispensing device comprising a rotary plate mounted to a rotary shaft for use in dispensing a coin and a base plate oppositely disposed at a predetermined distance relative to said rotary plate, wherein said coin dispensing device comprises:

guide holes passing through said rotary plate;

agitating members each of which is cooperatively associated with each of said guide holes and which travels along a predetermined orbit on said base plate by means of rotation of said rotary plate; and an extrusion member disposed on said base plate along the orbit so that said agitating members are caused to pass thereon, said extrusion member has a predetermined height relative to said base plate to enable a portion of said agitating member to protrude as an agitation protruding portion through said guide hole from said rotary plate, and is elastically deformed by a predetermined stress applied to said agitating member protruding from said rotary plate.

2. A coin dispensing device as claimed in claim 1, wherein said extrusion member comprises, at least a part thereof, an elastic material.

3. A coin dispensing device as claimed in claim 1, wherein said extrusion member is a cantilevered spring plate having a free end extending in said rotation direction of said rotary plate.

4. A coin dispensing device as claimed in claim 1, wherein said agitation protruding portion comprises, at least a part thereof, a spherical surface portion.

5. A coin dispensing device as claimed in claim 1, wherein said agitation protruding portion comprises, at least a part thereof, an elastomer material.

6. A coin dispensing device as claimed in claim 5, wherein the lower end portion of said agitating member comprises a lubricant at the spherical surface portion.

7. A coin dispensing device as claimed in claim 1, wherein a lower end portion of said agitating member which rides on the base plate comprises, at least a part thereof, a spherical surface portion.

8. A coin dispensing device as claimed in claim 1, wherein said agitating member is substantially spherical in shape.

9. A coin dispensing device as claimed in claim 8, wherein said rotary plate comprises a flange portion defining each of said guide holes, and said flange portion has a protrusion taper surface corresponding to that of the spherical agitating member.

10. A coin dispensing device as claimed in claim 1, wherein said rotary plate comprises a flange portion defining each of said guide holes, and wherein a lower end portion of said agitating member has an engaging piece which engages with said flange portion when said agitating member is protruding above the rotary plate.

11. A coin dispensing device as claimed in claim 10, wherein said device further comprises a forcing member disposed between said flange portion and said engaging piece for forcing said agitating member to said base plate.

* * * * *